US008641830B2

(12) United States Patent
Molitor et al.

(10) Patent No.: US 8,641,830 B2
(45) Date of Patent: Feb. 4, 2014

(54) GRAVIMETRIC DISPENSING SYSTEM

(75) Inventors: Christopher Molitor, Savage, MN (US); David Kensinger, Richfield, MN (US); Karl J. Fritze, Hastings, MN (US); Jaime L. Harris, Rosemount, MN (US)

(73) Assignee: Hydra-Flex, Inc., Burnsville, MN (US)

( * ) Notice: Subject to any disclaimer, the term of this patent is extended or adjusted under 35 U.S.C. 154(b) by 111 days.

(21) Appl. No.: 13/176,591

(22) Filed: Jul. 5, 2011

(65) Prior Publication Data

US 2012/0138628 A1 Jun. 7, 2012

Related U.S. Application Data

(60) Provisional application No. 61/361,224, filed on Jul. 2, 2010.

(51) Int. Cl.
*B08B 3/04* (2006.01)

(52) U.S. Cl.
USPC ..... 134/34; 134/18; 134/21; 134/36; 222/55; 222/77

(58) Field of Classification Search
None
See application file for complete search history.

(56) References Cited

U.S. PATENT DOCUMENTS

2009/0026220 A1* 1/2009 Ramnarine ..... 222/1

* cited by examiner

*Primary Examiner* — Michael Kornakov
*Assistant Examiner* — Ryan Coleman
(74) *Attorney, Agent, or Firm* — Patterson Thuente Pedersen, P.A.

(57) ABSTRACT

Apparatus and related methods for continually measuring and dispensing precise amounts of bulk chemical in a car wash application. A gravimetric dispensing assembly can include a load cell and a syringe dosing pump that is suspended below the load cell such that an entire mass of the syringe dosing pump is communicated to the load cell. In this manner, the load cell can measure the actual mass of chemical being dispensed from the syringe dosing pump on a continuous basis without solely relying on the rated volumetric capacity of the syringe dosing pump. The syringe dosing pump can be driven by a stepper motor that can be pulsed as directed by a controller so as to maintain, increase or decrease an amount of bulk chemical being dispensed from the syringe dosing pump.

8 Claims, 12 Drawing Sheets

GRAVIMETRIC DISPENSING SYSTEM

PRIORITY CLAIM

The present application claims priority to U.S. Provisional Application Ser. No. 61/361,224 filed Jul. 2, 2010, and entitled "CHEMICAL DELIVERY DATA ACQUISITION SYSTEM", which is herein incorporated by reference in its entirety.

FIELD OF DISCLOSURE

The present application is directed to a chemical dispensing system. More specifically, the present invention is directed to a gravimetric dispensing system having an ability to deliver precision amounts of chemical to a chemical dilution and mixing system while monitoring and maintaining performance of the dispensing system in real-time.

BACKGROUND OF DISCLOSURE

Chemicals are use used in many fields and processes to treat a variety of substances. The field of chemical treatment for use in cleaning or cleansing particularly with aqueous solutions is of increasing importance today. As regulations controlling hazardous substances become further reaching and tighter in control, there is growing pressure to carefully manage chemical usage. Further, many of the chemicals used in aqueous cleaning applications are discharged into lakes, streams, and rivers and can contaminate our groundwater and environment.

A market has emerged over the last couple of decades to automatically wash automotive vehicles as more and more people do not have access to washing facilities nor time or desire to clean their own cars. The popularity of drive through car washes today has become a large business for chemical companies as a conduit to sell and consume various cleaning and treatment chemicals. Further, there is considerable competitive pressure to clean cars adequately for the best value so as to gain repeat business. This activity is driving unknown and excessive chemical usage and its subsequent damage to the environment. The typical car wash has little or no knowledge of the amount of chemical used for each washing event. The current methods of dispensing have inconsistencies and create excess waste.

Many of the car wash systems are using old technologies such as dosing pumps and inaccurate eductors to draw concentrated chemicals and mix them with a supply of washing water. The dilution ratios can vary substantially and change without notice. Further, even the best systems often do not supply a constant dilution rate during their dispensing. Managers and operators of the car wash need to understand the cost or chemical target per car in real time for each of the chemicals being used. The typical information that managers or operators get today is a visual indication of bulk usage only after perhaps dozens or hundreds of wash events. Further, making changes to the dilution rates are often cumbersome and inaccurate, particularly since there is no convenient and immediate method to measure their use in real time. Often, adjustments of the dosing or eduction are coarse and can be at cross purposes. The supplier of the chemicals desire that they use and sell more chemicals, while owners want to reduce their chemical usage and operating expense. Often, it is not known how the system is performing or who has made any adjustments to it.

Considerable technical progress has been made in the field of dispensing chemicals particularly as it relates to industrial washing systems such as car washes. These systems are gaining in complexity and sophistication but are still lacking necessary controls to keep them from operating as open-loop processes. It is a challenging pursuit to get fluid handling devices to operate long-term with the very caustic, acidic, and oxidizing chemicals used in cleaning. Often these chemicals range from less than 1 pH to 14 pH.

Typical Car Wash

A typical car wash chemical dispensing system can be seen in FIG. 2. A bulk container of concentrated chemical, which is typically sold in a tight-head 5-gallon polyethylene container, is connected to a venturi style eductor such as those used in a Hydrominder™, which is manufactured by Hydro Systems Company. This venturi eductor is used to create a crude dilution of the concentrated chemical in a batch tank as the process water flows through the eductor. The operator fills the batch tank manually or it is filled automatically using a float to sense the tank level. The batch tank holds a diluted aqueous solution of chemical and process water. A dosing-type positive displacement injector pump is pneumatically driven to dispense the diluted solution directly onto the cars usually controlled by PLC driven solenoid valves. The rate of batch chemical pulses is controlled by pneumatic flow controls which regulate the supply of air driving the pump. FIG. 3 shows the characteristic chemical concentrations that result at the dispensing nozzle. The final concentration varies according to time and is dependent on the relative concentration of the batching process, the dosing pump rate, and the flow rate and pressure of the incoming process water. There are many process variables which create difficulty in fine-tuning the dilution rate; incoming water pressure and flow rate, eductor setting, and dosing pump rate and displacement and batch chemical concentrations. These systems need to be simplified and the variables reduced to effectively determine the amount of chemical being used in real time and to subsequently control their usage.

Improved Car Wash

With the development of Chem-Flex™ Injectors (venturi eductors) manufactured by Hydra-flex Incorporated, it is now practical to provide consistent long-term dilution rates ranging from 3:1 to 2000:1. With these devices, stable chemical dilution rates are achievable when directly feed with concentrated chemicals and without an intermediate batching process. A system which is stable in operation can be used to achieve a repeatable process. Even though a venturi-based chemical dispensing system using Chem-Flex™ type injectors is considerably more compact and simpler in operation; there is still no convenient method to determine how much chemical is being fed into any injector in real time. The method of dispensing chemicals remains open-loop without chemical feed rate control. It is only after several chemical dispensing events that the level of the chemical container can be seen to change. Considering that certain cleaning chemicals can have a dilution rate of 400:1, it would take over three gallons of dispensed diluted chemical solution to be able to resolve a single ounce of concentrated chemical. Considering that the level of a 5 gallon container has approximately 12 inches of chemical head and holds 640 ounces of chemical, just one ounce of chemical changes the level by 0.019" which is nearly impossible to read visually. Using this improved eductor based system, it is still not possible to obtain a per wash cost in real time and requires many wash events averaged over a significant time before meaningful information can be obtained to make process corrections.

What is needed is a dosing system that is both accurate and precise without flow pulsations and able to blend concentrated chemicals into a high-pressure stream for spray dispensing.

SUMMARY OF DISCLOSURE

The present invention addresses the need to continually measure and dispense precise amounts of chemical by continually measuring a chemical mass that is dispensed to a car wash application. A gravimetric dispensing assembly of the present invention can comprise a load cell and a syringe dosing pump that is suspended below the load cell such that an entire mass of the syringe dosing pump is communicated to the load cell. In this manner, the load cell can measure the actual mass of chemical being dispensed from the syringe dosing pump on a continuous basis without solely relying on the rated volumetric capacity of the syringe dosing pump. The syringe dosing pump can be driven by a stepper motor that can be pulsed as directed by a controller so as to maintain, increase or decrease an amount of bulk chemical being dispensed from the syringe dosing pump. In certain embodiments, a plurality of gravimetric dispensing assemblies can be simultaneous mounted to a common frame such that a plurality of chemical are simultaneously dispensed from a common location.

In one aspect, the present invention is directed to a gravimetric dispensing assembly comprising a load cell and a syringe dosing pump. The syringe dosing pump is suspended below the load cell such that a pump mass is communicated to an upper weight bearing plate located on the load cell. In this manner, the load cell continually measures a mass of a bulk chemical dispensed from a liquid end of the syringe dosing pump. The syringe dosing pump can include a stepper motor that can be controlled so as to selectively maintain, increase or decrease the amount of bulk chemical being dispensed from the gravimetric dispensing assembly.

In another aspect, the present invention is directed to a method of supplying a bulk chemical for application onto a vehicle within a car wash. The method can comprise drawing an amount of a bulk chemical into a liquid end of a syringe dosing pump. Next, the method can comprise pressurizing the bulk chemical within the syringe dosing pump such that the bulk chemical is directed out of the syringe dosing pump and into a venturi eductor. The method can further comprise weighing a mass of the bulk chemical dispensed with each stroke of a plunger in the syringe dosing pump using a load cell. Finally, the method can further comprise controlling a stroke frequency of the syringe dosing pump with a controller that continually monitors the mass of the bulk chemical being dispensed.

In yet another aspect of the present invention, a chemical dispensing assembly can comprise a load cell mounting frame having a plurality of gravimetric dispensing assemblies. Each gravimetric dispensing assembly can comprise a load cell and a syringe dosing pump suspended below the load cell. Tension plates can communicate a total mass of each syringe dosing pump to an upper weight bearing plate on the corresponding load cell such that the load cell continually measures a mass of a bulk chemical dispensed from the particular syringe dosing pump.

The above summary of the present disclosure is not intended to describe each illustrated embodiment or every implementation of the present invention. The Figures and the Detailed Description that follow more particularly exemplify these embodiments

BRIEF DESCRIPTION OF FIGURES

The disclosure can be more completely understood in consideration of the following detailed description in various embodiments of the invention in connection with the accompanying drawings, in which.

Figure 1:
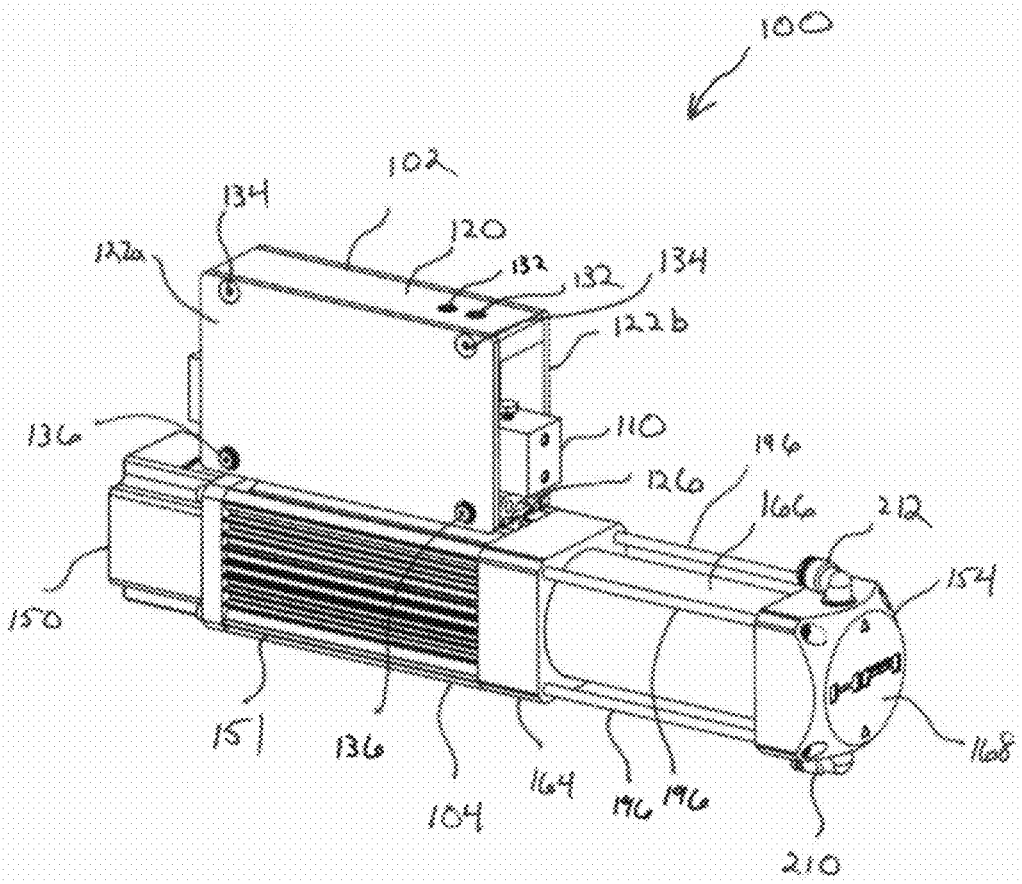
FIG. 1 is a perspective view of a gravimetric dispensing assembly according to a representative embodiment of the present invention.
Figure 2:
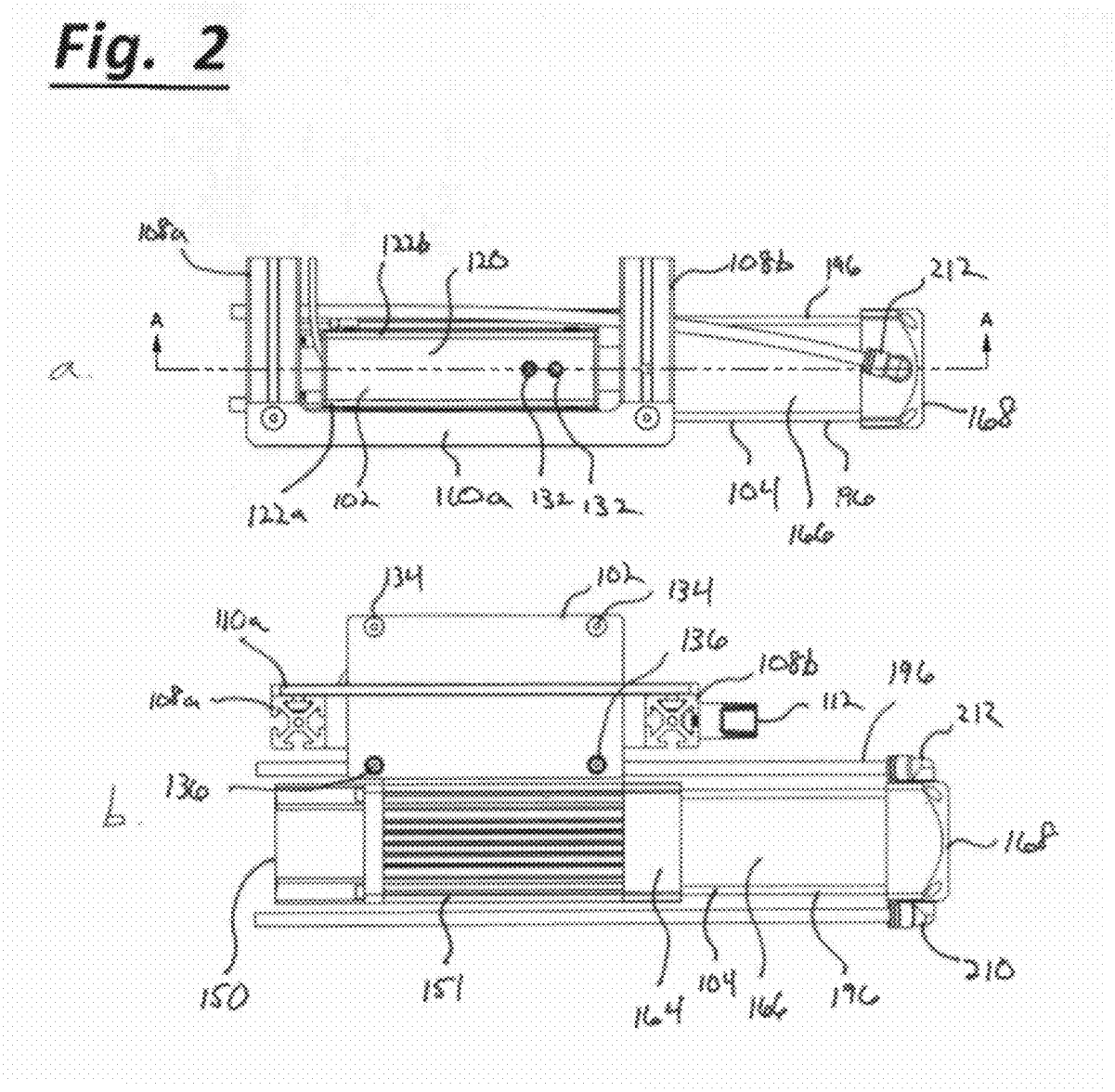
FIG. 2*a* is a top view of the gravimetric dispensing assembly of FIG. 1 mounted on a load cell mounting frame.
FIG. 2*b* is a side view of the gravimetric dispensing assembly of FIG. 2*a*.
Figure 3:
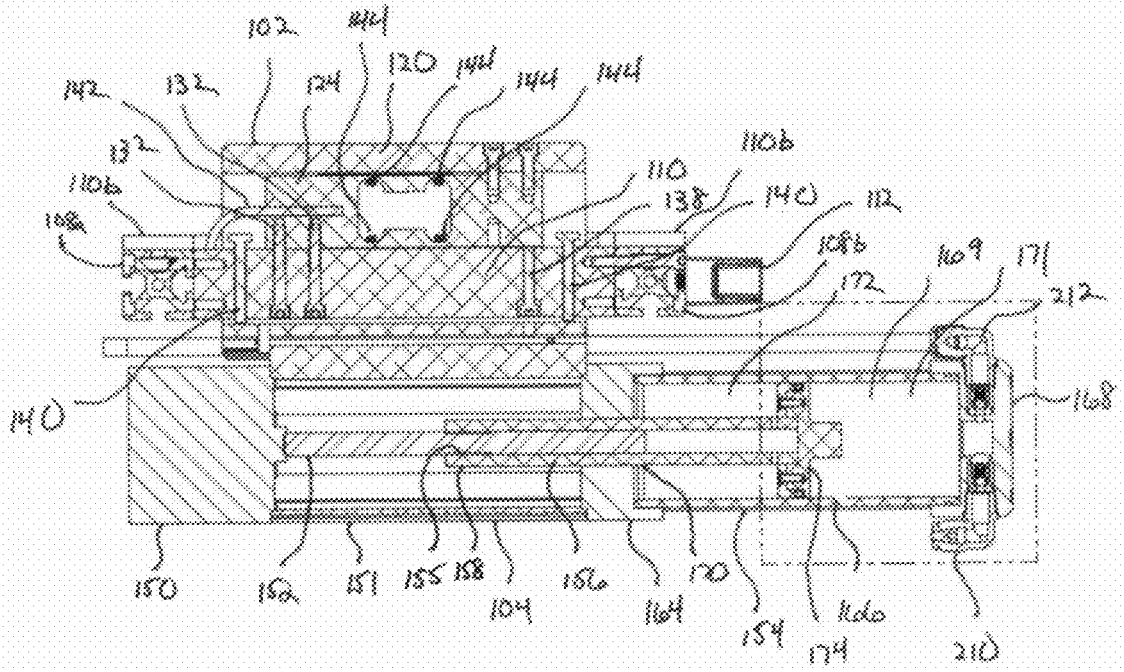
FIG. 3 is a section view of the gravimetric dispensing assembly of FIG. 2*a* taken at line a-a of FIG. 2*a*.
Figure 4:
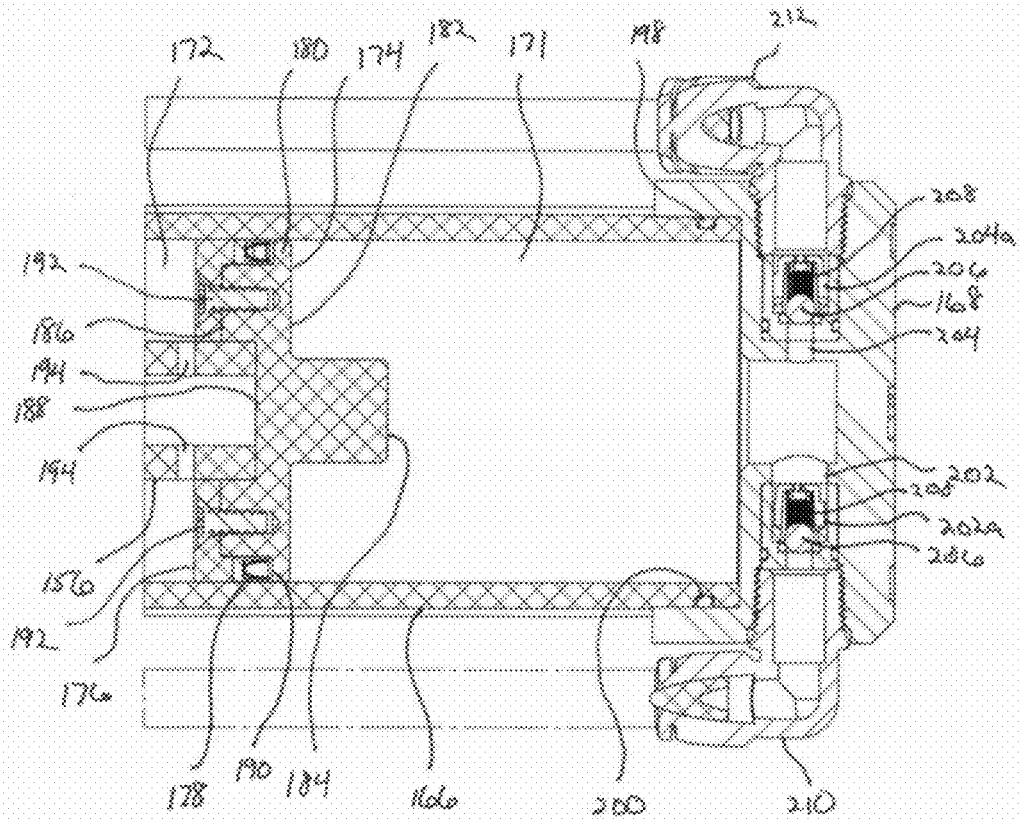
FIG. 4 is a detail section view of a fluid chamber of a syringe dosing pump according to a representative embodiment of the present invention.
Figure 4A:
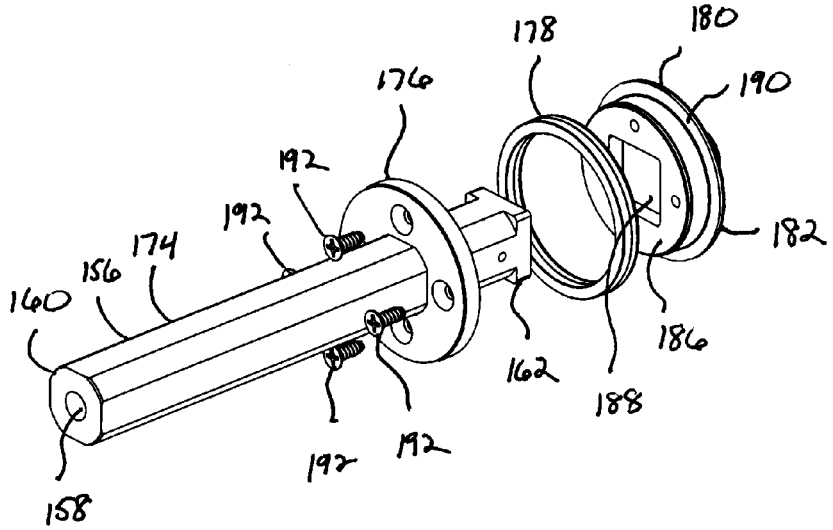
FIG. 4*a* is a perspective view of a piston liquid end of a syringe dosing pump according to an embodiment of the present invention.
Figure 4B:
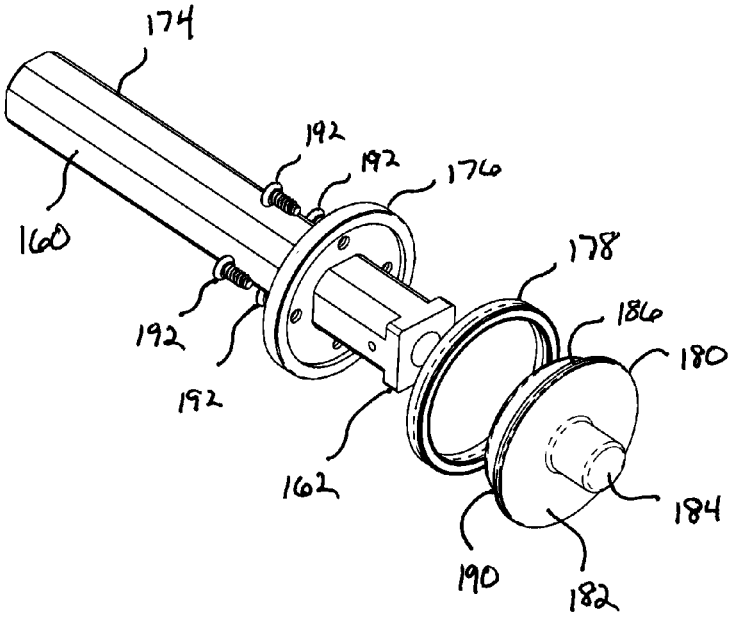
FIG. 4*b* is a perspective view of the piston liquid end of FIG. 4*a*.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modification, equivalents, and alternatives falling within the spirit and scope of the disclosure.

DETAILED DESCRIPTION OF FIGURES

Figure 5:
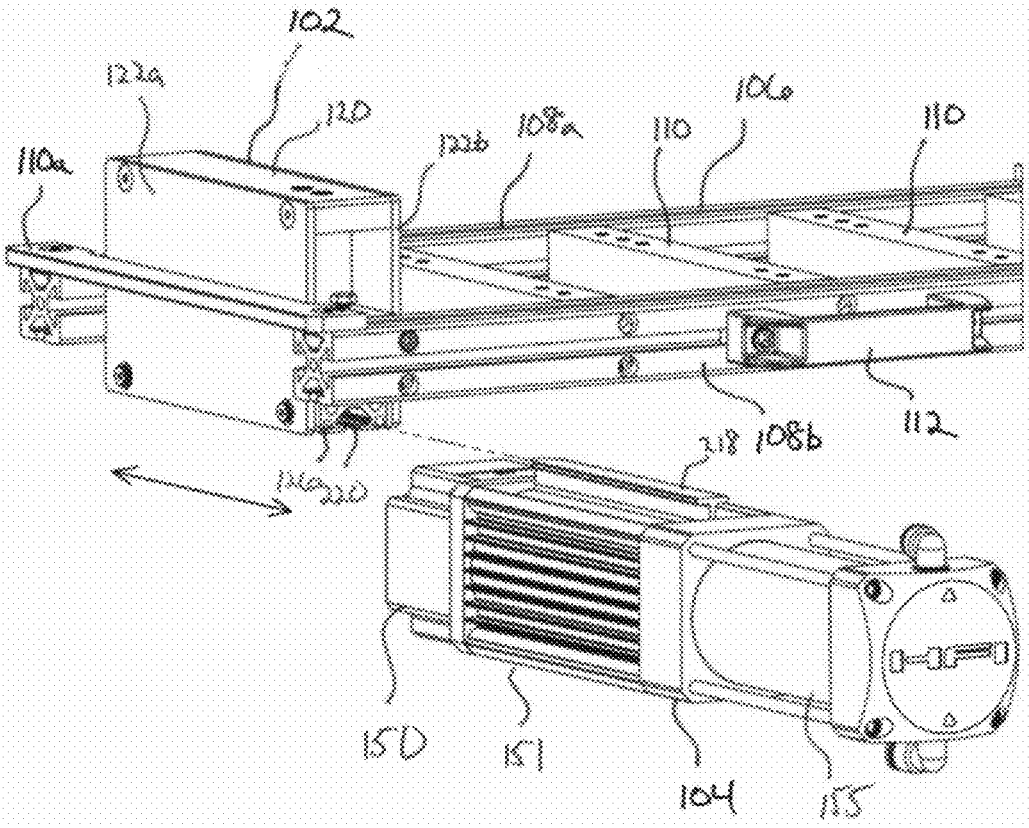
FIG. 5 is a perspective view of a syringe dosing pump connecting to a load cell mounted on a load cell mounting frame according to an embodiment of the present invention.
Figure 6:
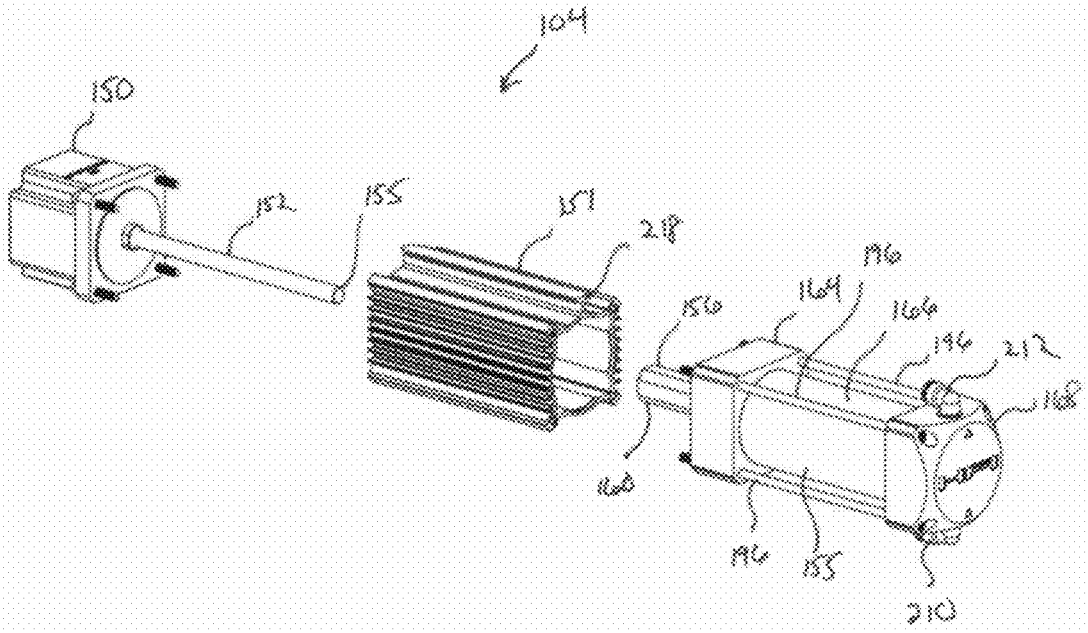
FIG. 6 is an exploded perspective view of a syringe dosing pump according to an embodiment of the present invention.

As illustrated in FIG. 1, a representative embodiment of a gravimetric dispensing assembly 100 of the present invention can generally comprise a load cell assembly 102 and a syringe dosing pump 104. One or more of the gravimetric dispensing assemblies 100 can be assembled and attached to a load cell mounting frame 106 as shown in FIG. 5. Load cell mounting frame 106 can comprise a pair of frame members 108*a*, 108*b* and a plurality of load cell support members 110 operably connected between the frame members 108*a*, 108*b*. At the ends of the frame members 108*a*, 108*b*, a pair of rack mounting members 110*a*, 110*b* can be operably attached between the frame members 108*a*, 108*b*. A handle member 112 can be operably connected to frame member 108*a*. Load cell mounting frame 106 can be constructed of suitable rigid materials having adequate strength for supporting the gravimetric dispensing assemblies. For instance, load cell mounting frame can be constructed of aluminum and can be painted or otherwise treated to provide chemical resistance properties.

Referring now to the FIGS. 1, 2*a*, 2*b*, 3, 4 and 5, load cell assembly 102 generally comprises an upper weight bearing plate 120, a pair of tension plates 122*a*, 122*b*, an off center single point load cell 124 and a mounting member 126. In general, load cell assembly 102 is assembled by first attaching the load cell 124 to the corresponding load cell support member 110 with a pair of support mounting bolts 128 inserted upward through mounting bores 130 and into the load cell assembly 102. Upper weight bearing plate 120 is coupled to the load cell 124 with a pair of upper mounting bolts 132. Tension plates 122*a*, 122*b* are attached to the upper weight bearing plate 120 with a pair of upper tension bolts 134 while a pair of lower tension bolts 136 affix the tension plates 122*a*, 122*b* to the mounting member 126. Lower tension bolts 136 preferably include rubber grommets so as to dampen any vibration due to operation of the syringe dosing pump 104. A downward limit screw 138 physically limits downward movement of the load cell 124 while a pair of upward limit screws 140 physically limit the upward movement of the load cell. Upward limit screws 140 prevent upward shock loads from exceeding the safe working range of the load cell 124 which can be damaged when loads approach 300% of the rated capacity of the load cell 124. Downward limit screw 138 similarly prevents shock loads in a downward direction. The downward limit screw 138 and upward limit screws 140 can be finely adjusted to a few thousandths of an inch to control excess weight loads and allow only loads within the safe operation range of the load cell 124. For example, the rated load of the present embodiment can be 10 Kg and can therefore be damaged by 30 Kg loads. A strain cable 142 communicates with four strain gauges 144 within the load cell 124.

As illustrated in FIGS. 1, 2*a*, 2*b*, 3, 4*a*, 4*b*, 5, and 6, syringe dosing pump 104 generally comprises a stepper motor 150, a housing 151 and a liquid end 155. In some embodiments, stepper motor 150 can further comprise an encoder allowing for precise control and determination of motor position. Stepper motor 150 includes a rotating shaft 152 having a threaded end 155. Threaded end 155 is rotatably insertable into a piston 156 having an internally threaded end 158. Piston 156 has a non-circular cross-section 160 and a flanged plunger end 162. Piston 156 can be constructed of suitable materials including, for example, polyethylene, polypropylene and ultra high molecular weight polyethylene. Liquid end 155 includes a cap member 164, a fluid chamber 166 and a flow cap 168. Cap member 164 includes a non-circular opening 170 that is slightly oversized but otherwise corresponding with the non-circular cross-section 160 such that non-circular opening 170 prevents any rotation of piston 156. Fluid chamber 166 includes an internal volume 169 defined by a wet volume 171 and a dry volume 172 on opposite side of a plunger 174. Plunger 174 comprises a connecting plate 176, a spring energized lip seal 178 and a plunger body 180. Plunger body 180 includes a wet surface 182 having a projecting member 184 and a dry surface 186 defining a connection recess 188 corresponding to the size and shape of the flanged plunger end 162. Projecting member 184 helps to maximize the swept volume within the wet volume 171. Flanged plunger end 162 is inserted into the connection recess 188 and lip seal 178 is positioned along a plunger flange 190 defined about the perimeter of the dry surface 186. Connecting plate 176 is directed into proximity with the dry surface 186 such that a plurality of plate screws 192 can operably connect the connecting plate 176 to the plunger body 180 while compressing the lip seal 178 at the periphery of the dry surface 186. As the connecting plate 176 attaches to the plunger body 180, flanged plunger end 162 is captured such that any movement of the piston 156 causes the plunger 174 to move similarly within the fluid chamber 166. Piston 156 can include one or more air vents 194 so as to vent any air within the piston 156 as the rotating shaft 152 rotates forward and back within the piston 156.

Flow cap 168 is positioned to close the wet volume 171 of the fluid chamber 166 and attaches to housing 151 with a plurality of threaded rods 196. Housing 151 also attaches to stepper motor 150 such that rotating shaft 152 and piston 156 are covered to prevent users from being exposed to moving parts. A flow cap seal 198 is positioned within a perimeter channel 200 on an exterior of the fluid chamber 166 and is compressed as the threaded rods 196 are tightened to from a fluid tight seal between the flow cap 168 and the fluid chamber 166. Flow cap 168 defines a fluid inlet 202 and a fluid outlet 204 that are each in fluid communication with the wet volume 171 of the fluid chamber 166. An inlet check valve module 202*a* is mounted within the fluid inlet 202 while an outlet check valve module 204*a* is mounted within fluid outlet 204. Inlet check valve module 202*a* and outlet check valve module 204*a* are essentially identical with the exception of their mounting orientation within the fluid inlet 202 and fluid outlet 204. Both the inlet check valve module 202*a* and outlet check valve module 204*a* include a check ball 206 and a spring 208. Spring rates for the springs 208 can be tailored for specific use. In a presently preferred embodiment when syringe dosing pump 104 is used with a downstream venturi eductor, the venturi eductor can pull a net vacuum of 25" mercury which is equivalent to 12.3 psig vacuum. If the outlet check valve module 204*a* is able to crack at this pressure, then chemical will be drawn through the syringe doing pump 104 just by action of the venturi eductor even with the syringe piston 156 holding position. Therefore, it is presently preferred to provide an outlet check valve module 204*a* with a cracking pressure greater than the vacuum capacity of such a venturi eductor. Alternatively, suitable solenoid or pilot-operated valves can be employed to lock the fluid inlet 202 and fluid outlet 204 to allow pump priming and only allow fluid flow during operation of the syringe dosing pump 104. Inlet check valve module 202*a* is captured within the fluid inlet 202 with an inlet fitting 210 and outlet check valve module 204*a* is captured within the fluid outlet 204 with an outlet fitting 212. Inlet fitting 210 and outlet fitting 212 are preferably quick connect style fittings that allow for quick connection of inlet tubing 214 and outlet tubing 216.

In a present embodiment, syringe dosing pump 104 can be capable of dispensing from 0.001 gpm to 0.300 gpm which requires the stepper motor 150 to be a 300:1 speed range motor. The current embodiment utilizes a stepper motor due to its very low rpm capability, high torque, wide speed range, ease of control, and low-cost economics. A stepper motor indexes one step for each pulse of power it receives. Stepper motors are typically configured to require 200 steps per revolution or each step is 0.9 degrees of rotation. For the presently preferred example, the piston diameter is 2.50" and the stroke is 6.50" resulting in a pumping volume of 523 ml. Using a 10 pitch acme threaded lead-screw, the stepper motor needs to spin from 0.47 rpm to 141 rpm which results in linear piston speeds of 0.047 to 14.1. The stepper motor 150 requires a pulse frequency of 1.57 to 470.5 Hz to drive the piston 156 accordingly.

With assembly of the load cell assembly 102 and syringe dosing pump 104 being completed, syringe dosing pump can be operably connected to the load cell assembly 102 as illustrated in FIG. 5. Housing 151 can include a mounting beam 218 having a profile matching a mounting channel 220 defined in the mounting member 126. Syringe dosing pump 104 is manipulated such that mounting beam 218 is slidingly inserted into the mounting channel 126. With the mounting beam 218 fully positioned with the mounting channel 126, the total weight of the syringe dosing pump is carried through the tension plates 122*a*, 122*b* to the upper weight bearing plate 120. In this manner, the total weight of syringe dosing pump 104 is measured by the load cell 124 even with the syringe dosing pump 104 being suspended below the load cell 124. In this manner, load cell 124 is able to continually measure the weight of any fluid dispensed from the liquid end 155. Essentially, the weight of the syringe dosing pump 104 pulls downward on the mounting member 126 which in turn pulls the tension plates 122*a*, 122*b* downward. The upper weight bearing plate 120 is forced downward which imparts the weight and deflection to the load cell 124. In one preferred embodiment, the load cell 124 is a single-point cell which is a precision, friction-free 4-bar mechanism that intensifies distortion in the aluminum load cell body placing a strain upon strain gauges 144. As the strain gauge 144 stretch, their resistance changes and an excitation voltage returns a small change in signal proportional to the applied load which is communicated through the strain cable 142.

Figure 7:
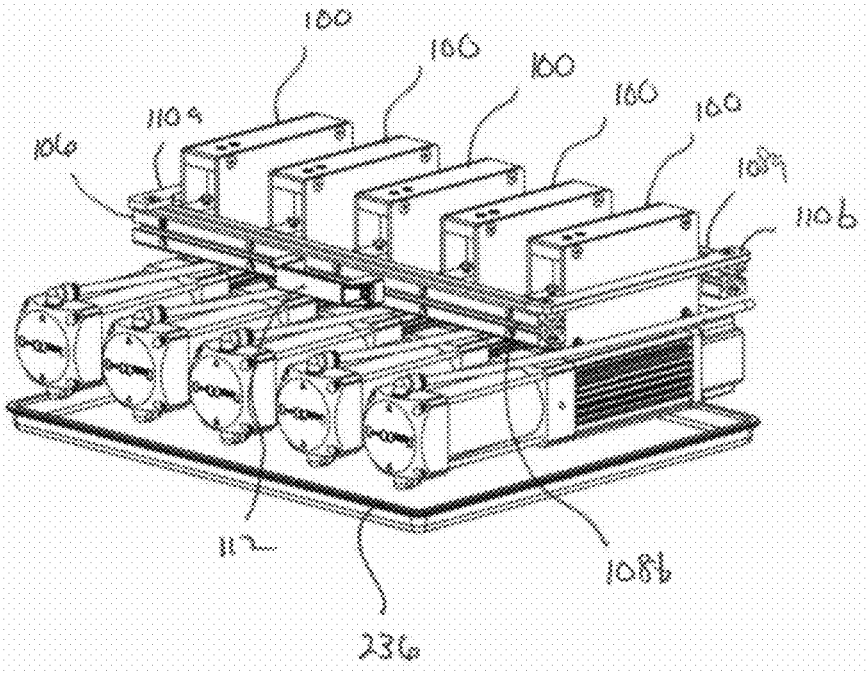
FIG. 7 is a perspective view of a plurality of gravimetric dispensing assemblies mounted to a load cell support frame.
Figure 8:
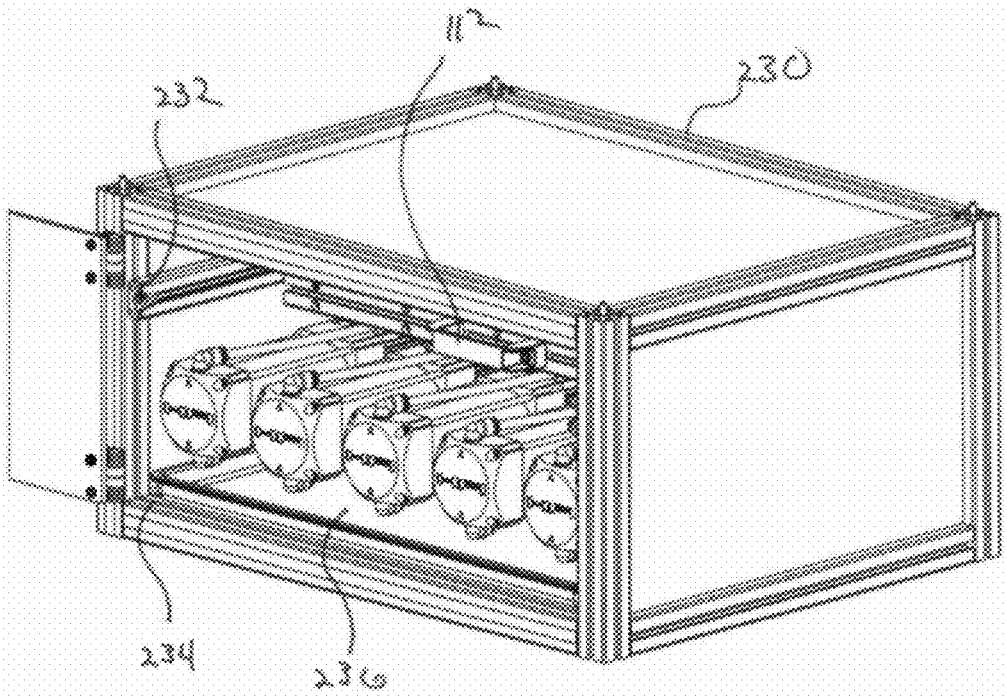
FIG. 8 is a perspective view of the load cell support frame of FIG. 7 positioned within a dispensing assembly according to an embodiment of the present invention.
Figure 9:
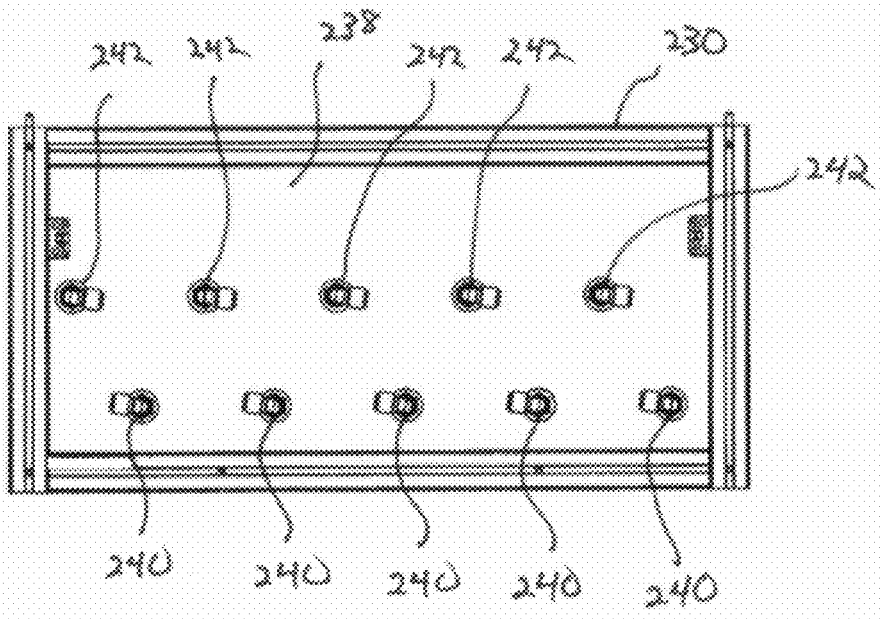
FIG. 9 is a rear view of the dispensing assembly of FIG. 8.
Figure 10:
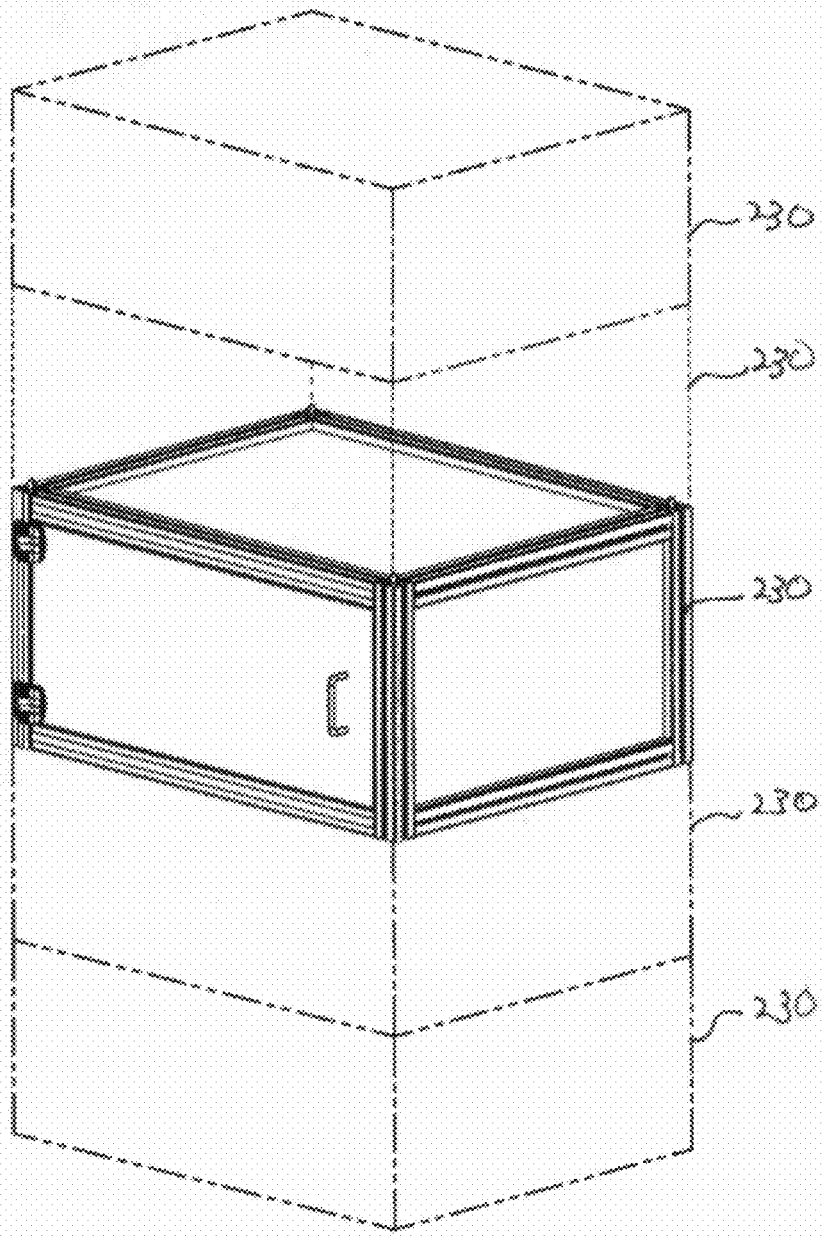
FIG. 10 is a perspective view of a plurality of dispensing assemblies of FIG. 7 arranged in a vertical stack.

As illustrated in FIGS. 7, 8 and 9, a plurality of gravimetric dispensing assemblies 100 can be attached to the load cell mounting frame 106 base upon the number of individual chemicals being utilized at a manufacturing or service location. Each gravimetric dispensing assembly 100 can be individually assembled on its corresponding load cell support member 110. Once the desired number of gravimetric dispensing assemblies 100 have been assembled, the load cell mounting frame 106 can be slidingly positioned within a dispensing cabinet 230. Dispensing cabinet 230 can include a pair of horizontal mounting channels 232 into which the rack mounting members 110*a*, 110*b* are slidingly inserted. The horizontal mounting channels 232 support the load cell mounting frame 106 and gravimetric dispensing assemblies 100 above a cabinet floor 234 and can allow for the entire load cell mounting frame 106 to be slidingly removed for maintenance or replacement by grasping and pulling the handle member 112. In some embodiments, a drip trap 236 can be placed on the cabinet floor 234 to capture any chemical that otherwise leaks from the gravimetric dispensing assemblies 100. As seen in FIG. 9, dispensing cabinet 230 can comprise a rear panel 238 including an inlet connection 240 and outlet connection 242 for each of the individual gravimetric dispensing assemblies 100. As illustrated in FIG. 10, locations requiring many different gravimetric dispensing assemblies 100 can vertically stack a plurality of cabinets 230, wherein each cabinet includes a plurality of gravimetric dispensing assemblies 100. Cabinet 230 can be manufactured of suitable materials such as aluminum extrusions and clear plastic panels such as acrylic, polycarbonate, isoplast, or opaque panels such as PVC, ABS, or Polypropylene as desired.

Figure 11:
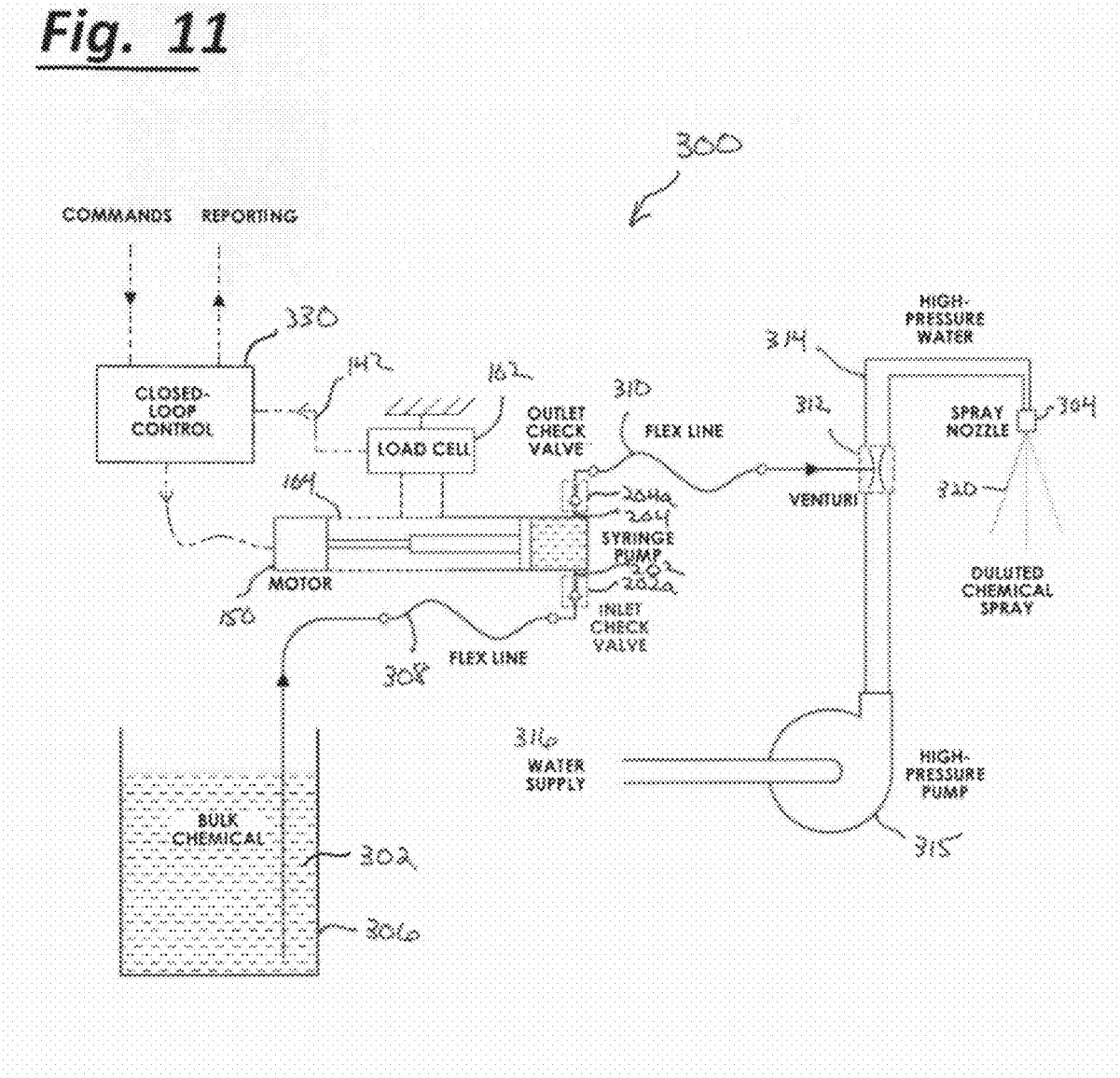
FIG. 11 is a schematic diagram illustrating use of the gravimetric dispensing assembly of FIG. 1 in a car wash installation.

Referring now to FIG. 11, a representative chemical dispensing installation 300 utilizing the gravimetric dispensing assembly 100 of the present invention is illustrated. As seen in FIG. 11, chemical dispensing installation 300 can comprise a car wash wherein a bulk chemical 302, such as a detergent, wax or other suitable car wash chemical is delivered to a spray nozzle 304 for application onto a vehicle. In a preferred embodiment, bulk chemical 302 is supplied as in a concentrated or hyper-concentrated form such that the overall size of a chemical container 306 can be reduced, for example, from a 55 gallon drum to a 5 or 10 gallon drum, while still providing for extended periods of operation. Bulk chemical 302 is stored within chemical container 306 at atmospheric pressure. A flexible inlet line 308 fluidly interconnects the chemical container 306 with the fluid inlet 202 of the syringe dosing pump 104 while a flexible outlet line 310 fluidly interconnects the fluid outlet 204 to a low pressure side of a venturi eductor 312 that is mounted within a high pressure supply line 314. Flexible inlet line 308 and flexible outlet line 310 can comprise translucent PVC tubing due to its wide range of performance and economics. Alternately, materials such as polyethylene, PTFE, Kynar, nylon, etc. are also possible particularly depending on the range of chemicals targeted. High pressure supply line 314 includes a high pressure pump 315 that pressurizes a motive fluid 316, such as water in a typical car wash installation. The pressurized motive fluid 316 enters the venturi eductor 312 wherein the internal geometry of the venturi eductor 312 creates a vacuum that draws and mixes the bulk chemical 302 into the motive fluid 316 to form a mixed solution 320 such as, for example, a cleaning solution in a car wash application. The mixed solution 320 is applied to a vehicle through spray nozzle 304.

As seen in FIG. 11, a controller 330 is operably connected to the gravimetric dispensing assembly 100. Controller 330 can comprise a suitable processor based controller such as, for example, a programmable logic controller or computer based controller. Strain cable 142 communicates with controller 330 and provides real-time readings of the mass of bulk chemical 302 being dispensed from syringe dosing pump 104 to the controller 330 as measured by the strain gauges 144. Based on the mass of the bulk chemical 302 being dispensed from fluid outlet 204, controller 330 can selectively maintain, increase or decrease the rate at which the stepper motor 150 is pulsed which will corresponding maintain, increase or decrease the rate at which the mass of bulk chemical 302 is dispensed to the venturi eductor 312.

Gravimetric dispensing assembly 100 provides a number of advantages when utilized in chemical dispensing installation 300. The amount of bulk chemical 302 supplied from the syringe dosing pump 104 is controlled through a combination of volumetric capacity and mass flow rate measurement that allow concentrated chemicals to be administered in small amounts such that the size of chemical container 306 can be reduced. Generally, the volumetric capacity of the syringe dosing pump 104 is controlled by increasing or decreasing the wet volume 171 within the fluid chamber 166. This adjustment is accomplished by selectively increasing or decreasing the length of the pulse from the stepper motor 150 such that rotating shaft 152 rotates more or less wherein a stroke length of piston 156 is increased or decreased based on its travel on threaded end 155. During operation, events can occur that lead to the bulk chemical 302 not completely filling the wet volume 171 such as, for example, if air is present within the fluid chamber 166. When this occurs, the mass of bulk chemical 302 that is dispensed out of the syringe dosing pump 104 is monitored on a real time basis by the load cell assembly 102. Controller 330 can then selectively increase or decrease the rate of pulses to the stepper motor 150 so as to dispense the desired mass of bulk chemical 302. In situations where an unexpected mass of bulk chemical 302 is being dispensed by syringe dosing pump 104, controller 330 can also produce a warning signal to an operator such that the operator can verify system performance and conform that issues such as, for example, running low on bulk chemical 302 or leaks within the flexible inlet line 308 can be corrected.

In operation, the syringe dosing pump 104 draws the bulk chemical 302 into the fluid chamber 166 when the stepper motor 150 is commanded by the controller 330 to rotate clockwise and pull the piston 156 outward causing a low-pressure within the wet volume 171. This low pressure within the wet volume 171 allows the inlet check valve module 202*a* to open so as to allow bulk chemical 302 to be drawn into the fluid inlet 202 and prevents reverse flow into the wet volume 171 from the fluid outlet 204. When the piston 156 reaches the end of stroke, the stepper motor 150 is then reversed to spin counter-clockwise to push the piston 156 towards the flow cap 168 and pushes the bulk chemical out of the outlet check valve module 204 while preventing back flow through the fluid inlet 202 and into the chemical container 306. With the syringe dosing pump 104 suspended from the load cell 124, very small changes in the weight of the syringe dosing pump 104 are continually weighed and monitored. Each cycle of the syringe dosing pump 104 can be weighed to determine the actual amount of bulk chemical 302 that has been transferred during the pumping event. Flexible inlet line 308 and flexible outlet line 310 allow small deflections in the load cell 124 to be nearly transparent to overall load cell sensitivity and are further assisted by preferably orienting the flexible inlet line 308 and the flexible outlet line 310 such that they are routed along the main axis of the gravimetric dispensing assembly 100. Additionally, any control cabling connected to the stepper motor 150 is preferably flexible and arranged so as to not impair the sensitivity of the load cell 124. Once the syringe dosing pump 104 is primed and the amount of bulk chemical 302 is known, the controller 330 can give a command to advance the stepper motor 150 at a particular rate, for example at 0.5 rpm. At this rate, it is expected that 0.001 gpm of bulk chemical 302 is being pushed into the venturi eductor 312. If the specific gravity of the bulk chemical 302 is 1.04, then (8.34 lbs/gallon×1.04×0.001 gpm=0.0087 lbs/min) 0.0087 lbs per minute of bulk chemical 302 should be dispensing and the syringe dosing pump 104 should be losing weight at this same rate. In the event that the loss-in-weight of the syringe dosing pump 104 is more or less than this amount, the stepper motor 150 can be commanded to increase or decrease as required to correct for this error. In this mode, syringe dosing pump 104 is essentially operating as a closed-loop servo. Since the venturi eductor 312 can produce a near perfect vacuum at the introduction port, it has the ability to scavenge chemical from the chemical tank 306 directly by cracking the inlet and outlet check valve modules 202*a*, 204*a*. Therefore, at least one of the inlet and outlet check valve modules can be set at a pressure higher than the low pressure of the venturi eductor 312. For example, if the venturi creates a vacuum of 25" mercury, then an outlet check valve module 204*a* which has a cracking pressure greater than (25/29.92×14.474 psi/atm=12.09 psig) such as 14 psi would prevent any bulk chemical 302 from bypassing the syringe dosing pump 104 when the venturi eductor 312 is producing its vacuum. In this case, the syringe dosing pump 104 can begin to supply bulk chemical 302 when the syringe dosing pump boost pressure is in excess of 14 psi. When the syringe pump piston moves forward, and pressurizes its chamber above the cracking pressure of the outlet valve check valve module 204*a*, the piston 156 can advance and allow bulk chemical 302 to flow into the venturi eductor 312. The venturi is operating in a water stream that has been boosted to high-pressure, for example as high as 14 atmospheres or 200 psig, and when this water is flowing through the venturi, the venturi is able to provide for the very low-pressure at its introduction port. Lastly, the chemical which is carefully metered by gravimetric closed-loop feedback is mixed and pressurized for subsequent spray dispensing. Fluid flow data which is proportional to the voltage signal output from the load cell is reported to the main control for further processing and reporting.

Although specific examples have illustrated and described herein, it will be appreciated by those of ordinary skill in the art that any arrangement calculated to achieve the same purpose could be substituted for the specific examples shown. This application is intended to cover adaptations or variations of the present subject matter.

What is claimed is:

1. A method of supplying a bulk chemical to a vehicle within a car wash, comprising:

drawing an amount of a bulk chemical into a liquid end of a syringe dosing pump;

pressurizing the bulk chemical within the syringe dosing pump such that the bulk chemical is directed out of the syringe dosing pump and is directed to a vehicle within a car wash;

weighing a mass of the bulk chemical dispensed with each stroke of a plunger in the syringe dosing pump using a load cell; and controlling a stroke frequency of the syringe dosing pump with a controller that continually monitors the mass of the bulk chemical being dispensed, wherein controlling the stroke frequency further comprises adjusting a pulse rate for a stepper motor attached to the syringe dosing pump.

2. The method of claim 1, further comprising:

producing a warning signal if the mass of the bulk chemical is different than an amounted expected by the controller.

3. The method of claim 1, further comprising:

suspending the syringe dosing pump below the load cell.

4. The method of claim 3, further comprising:

communicating a pump mass of the syringe dosing pump to an upper weight bearing plate of the load cell.

5. The method of claim 3, further comprising:

positioning a drip trap below the syringe dosing pump.

6. The method of claim 1, further comprising:

supplying the bulk chemical to a venturi eductor; and mixing the bulk chemical into a motive fluid using the venturi eductor to form a mixed solution.

7. The method of claim 6, further comprising:

applying the mixed solution to a vehicle.

8. The method of claim 6, further comprising:

providing a check valve on the syringe dosing pump having a cracking pressure greater than a vacuum level generated by the venturi eductor.

* * * * *